US009019041B2

(12) United States Patent
Tsai et al.

(10) Patent No.: US 9,019,041 B2
(45) Date of Patent: Apr. 28, 2015

(54) ONE INPUT TO FOUR OUTPUT POWER DIVIDER

(75) Inventors: Wen-Tsai Tsai, Hsinchu County (TW); Yu-Feng Lee, Hsinchu County (TW)

(73) Assignee: Wistron Neweb Corp., Hsinchu County (TW)

( * ) Notice: Subject to any disclaimer, the term of this patent is extended or adjusted under 35 U.S.C. 154(b) by 307 days.

(21) Appl. No.: 13/593,487

(22) Filed: Aug. 23, 2012

(65) Prior Publication Data

US 2013/0120078 A1 May 16, 2013

(30) Foreign Application Priority Data

Nov. 10, 2011 (TW) ..... 100141062 A

(51) Int. Cl.
*H01P 5/12* (2006.01)
*H01P 5/16* (2006.01)

(52) U.S. Cl.
CPC ..... *H01P 5/16* (2013.01)

(58) Field of Classification Search
CPC ..... H01P 5/16
USPC ..... 333/136
See application file for complete search history.

(56) References Cited

U.S. PATENT DOCUMENTS 8,723,618 B2 * 5/2014 Hirota et al. ..... 333/125
2010/0225417 A1 * 9/2010 Mistretta et al. ..... 333/128

FOREIGN PATENT DOCUMENTS

CN 101609918 (A) 12/2009

OTHER PUBLICATIONS

Pan Zili (1), Huang Jian(2), and Wang LuYu(2), "Design of Microstrip Broadband Wilkinson Power Divider", Abtract, (1)University of Electronic Science and Technology of China, Chengdu 610054; and (2)The 10th Institute of China Electronic Technology Group Corporation, Chengdu 610036.

* cited by examiner

*Primary Examiner* — Robert Pascal
*Assistant Examiner* — Kimberly Glenn
(74) *Attorney, Agent, or Firm* — Blakely Sokoloff Taylor & Zafman

(57) ABSTRACT

A one input to four output power divider is operable in a specified frequency band, and includes a first microstrip power divider, a first quarter-wavelength microstrip which has an end coupled electrically to one output terminal of the first microstrip power divider, a second microstrip power divider which has an input terminal coupled electrically to another end of the first quarter-wavelength microstrip, a second quarter-wavelength microstrip which has an end coupled electrically to the other output terminal of the first microstrip power divider, and a third microstrip power divider which has an input terminal coupled electrically to another end of the second quarter-wavelength microstrip.

6 Claims, 9 Drawing Sheets

ONE INPUT TO FOUR OUTPUT POWER DIVIDER

CROSS-REFERENCE TO RELATED APPLICATION

This application claims priority of Taiwanese Patent Application No. 100141062, filed on Nov. 10, 2011, and the disclosure of which is incorporated herein by reference.

BACKGROUND OF THE INVENTION

1. Field of the Invention

The present invention relates to a power divider, more particularly to a power divider with a microstrip structure.

2. Description of the Related Art

Referring to FIG. 1, a conventional one input to four output power divider 1 is composed of three one input to two output wired transformers 11, 12 and 13, and a plurality of resistors (not shown). However, adopting a structure using the wired transformers has some defects. First of all, the wired transformer has a higher component cost. Secondly, pins of the wired transformer are required to be arranged manually for subsequent soldering, such that only manual soldering may be adopted and SMT (Surface Mount Technology) soldering may not be utilized, resulting in longer working hours to solder the wired transformer. Thirdly, since the wired transformers are soldered manually, characteristics of the power divider may deviate as a result of differences in soldering among individuals.

Therefore, for the purpose of reducing cost, working hours for soldering and deviation in characteristics of the power divider, a conventional power divider with a microstrip structure designed based on a microstrip power divider is provided. Referring to FIG. 2, a conventional one input to four output power divider 2 includes three sets of single-stage one input to two output microstrip power dividers 21, 22 and 23. However, it is apparent from the S-parameters of the one input to four output power divider 2 illustrated in a simulation thereof in FIG. 3 that the reflection coefficients S(1, 1) of the one input to four output power divider 2 at 50 MHz and 700 MHz are poor, resulting in an insufficient working bandwidth. Therefore, the conventional one input to four output power divider is not suited to operate in a working frequency band ranging from 50 MHz to 806 MHz.

SUMMARY OF THE INVENTION

Therefore, an object of the present invention is to provide a one input to four output power divider which improves a working bandwidth of the one input to four output power divider with a microstrip structure designed based on a microstrip power divider.

Accordingly, the one input to four output power divider of the present invention is operable in a specified frequency band, and comprises a first microstrip power divider, a first quarter-wavelength microstrip, a second microstrip power divider, a second quarter-wavelength microstrip, and a third microstrip power divider.

The first microstrip power divider has an input terminal and two output terminals. The first quarter-wavelength microstrip has a length corresponding to a quarter of a wavelength of a signal at a specified frequency within the specified frequency band, has an end coupled electrically to one of the output terminals of the first microstrip power divider, and has a characteristic impedance substantially equal to an output impedance of the first microstrip power divider at said one of the output terminals coupled to the first quarter-wavelength microstrip. The second microstrip power divider has an input terminal and two output terminals. The input terminal of the second microstrip power divider is coupled electrically to another end of the first quarter-wavelength microstrip. The second microstrip power divider has an input impedance at the input terminal thereof substantially equal to the characteristic impedance of the first quarter-wavelength microstrip. The second quarter-wavelength microstrip has a length corresponding to a quarter of the wavelength of the signal at the specified frequency, has an end coupled electrically to the other one of the output terminals of the first microstrip power divider, and has a characteristic impedance substantially equal to an output impedance of the first microstrip power divider at said other one of the output terminals coupled to the second quarter-wavelength microstrip. The third microstrip power divider has an input terminal and two output terminals. The input terminal of the third microstrip power divider is coupled electrically to another end of the second quarter-wavelength microstrip. The third microstrip power divider has an input impedance at the input terminal thereof substantially equal to the characteristic impedance of the second quarter-wavelength microstrip.

Preferably, at least one of the first microstrip power divider, the second microstrip power divider and the third microstrip power divider has a design based on the Wilkinson power divider.

Preferably, each of the first microstrip power divider, the second microstrip power divider and the third microstrip power divider includes a first microstrip connected to the respective input terminal, a second microstrip and a third microstrip connected in series between the respective input terminal and one of the respective output terminals, a fourth microstrip and a fifth microstrip connected in series between the respective input terminal and the other one of the respective output terminals, and an output resistor connected between a junction of the second and third microstrips and a junction of the fourth and fifth microstrips. Each of the first, third and fifth microstrips has a characteristic impedance of $Z_0$, and each of the second and fourth microstrips has a characteristic impedance of $\sqrt{2}Z_0$. Preferably, $Z_0$ is 75 ohms.

Preferably, the output impedance of the first microstrip power divider at said one of the output terminals is substantially equal to the characteristic impedance of the third microstrip. The output impedance of the first microstrip power divider at said other one of the output terminals is substantially equal to the characteristic impedance of the fifth microstrip. The input impedance of each of the first, second and third microstrip power dividers at the respective input terminal is substantially equal to the characteristic impedance of the first microstrip.

Preferably, the one input to four output power divider further comprises five resistors each connected to a respective one of the input terminal of the first microstrip power divider, the two output terminals of the second microstrip power divider, and the two output terminals of the third microstrip power divider.

Preferably, the specified frequency band ranges from 50 MHz to 806 MHz. The specified frequency is 700 MHz. The characteristic impedance of each of the first and second quarter-wavelength microstrips is 75 ohms. Each of the five resistors has a resistance of 15 ohms.

BRIEF DESCRIPTION OF THE DRAWINGS

Other features and advantages of the present invention will become apparent in the following detailed description of the two embodiments with reference to the accompanying drawings, of which.

DETAILED DESCRIPTION OF THE EMBODIMENTS

Figure 1:
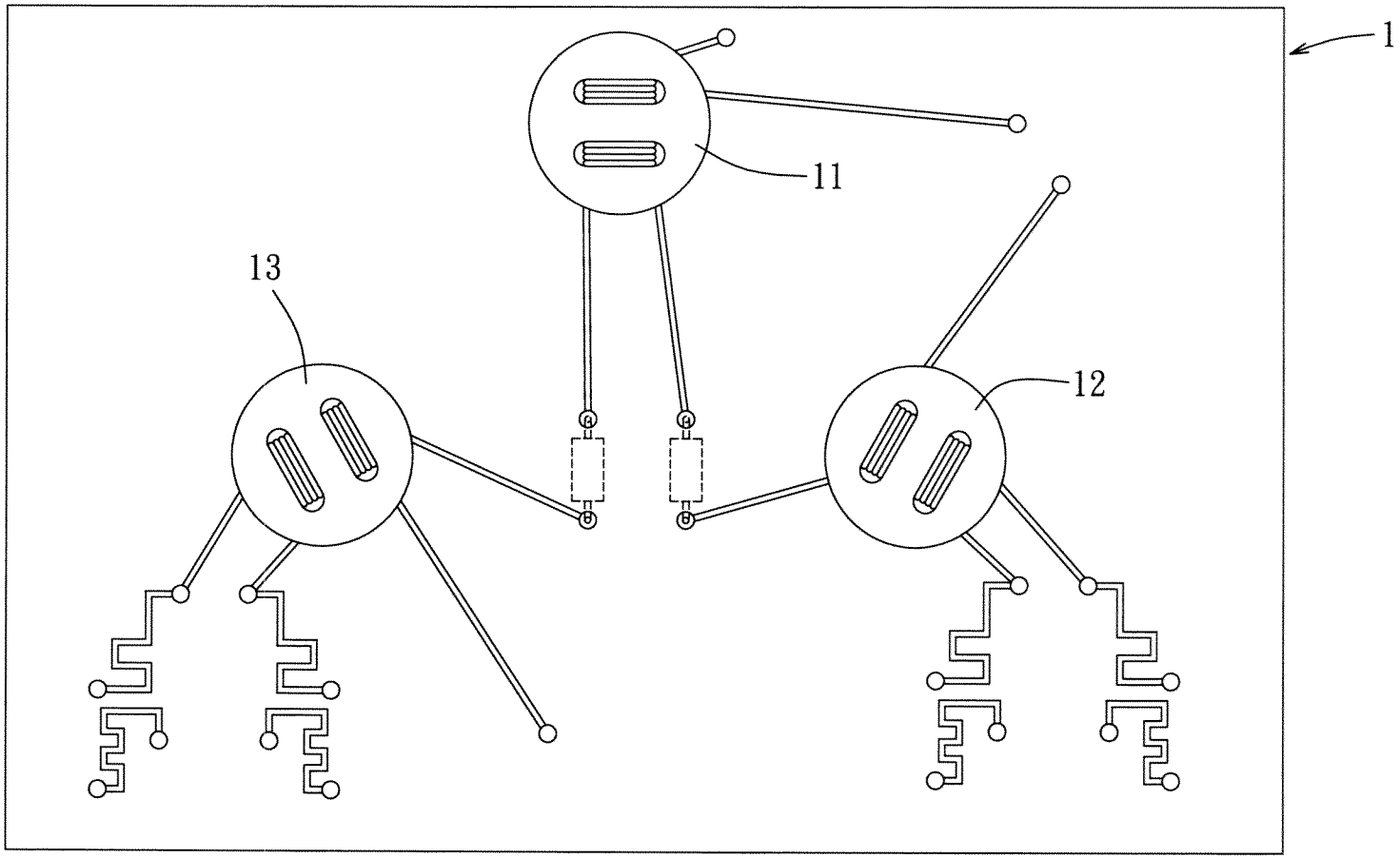
FIG. 1 PRIOR ART
FIG. 1 is a schematic diagram of a conventional one input to four output power divider composed of wired transformers.
Figure 2:
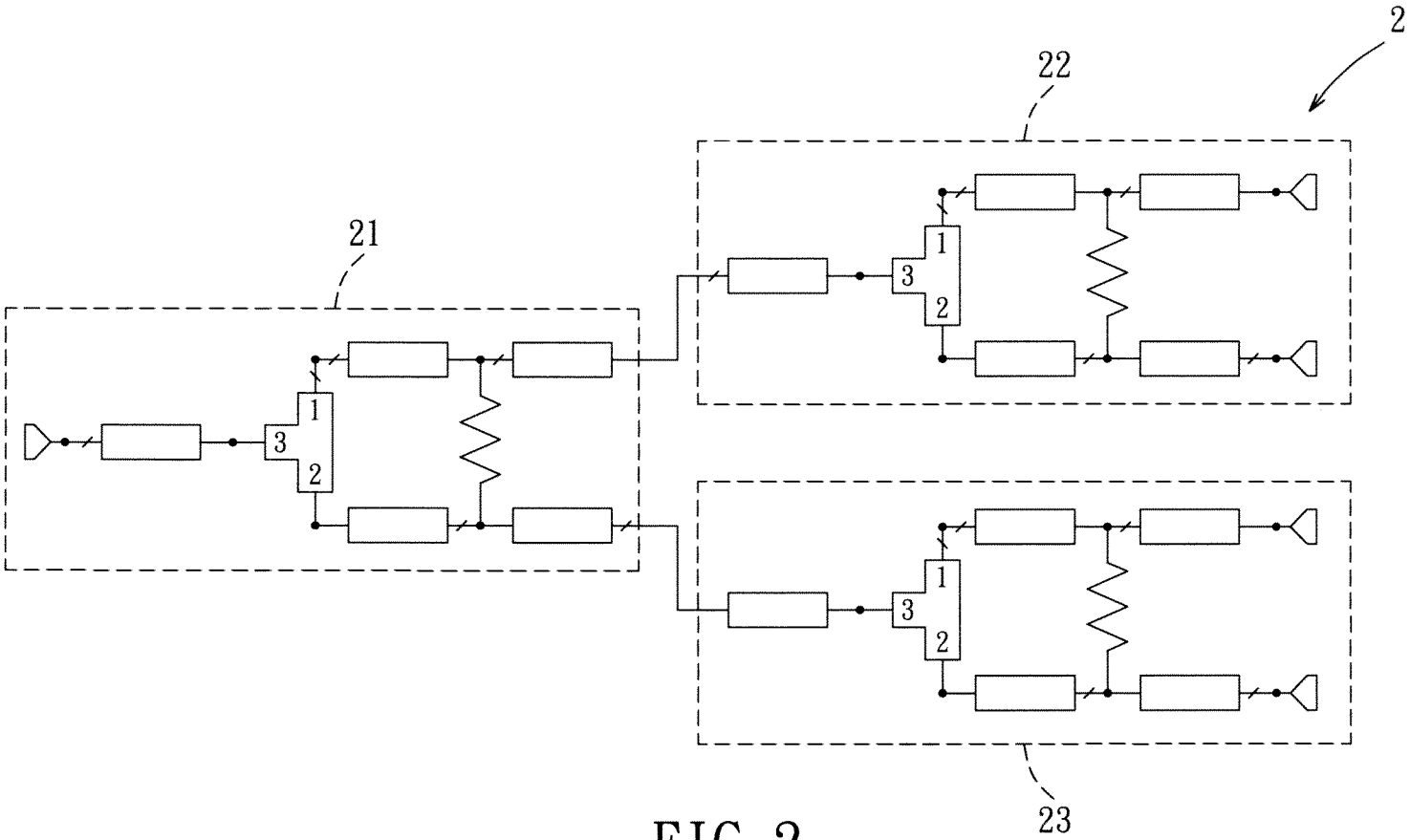
FIG. 2 PRIOR ART
FIG. 2 is a circuit diagram of a conventional one input to four output power divider which includes three sets of single-stage one input to two output microstrip power dividers.
Figure 3:
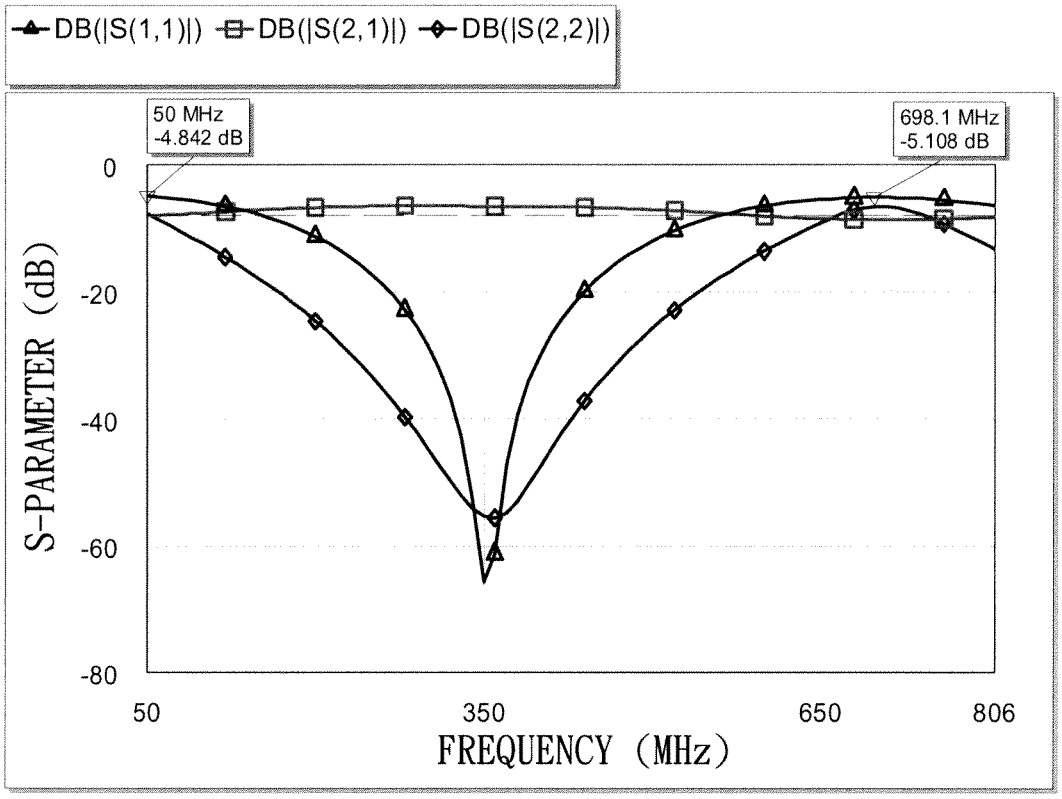
FIG. 3 PRIOR ART
FIG. 3 is a plot of S-parameter measured by simulating the one input to four output power divider in FIG. 2.
Figure 4:
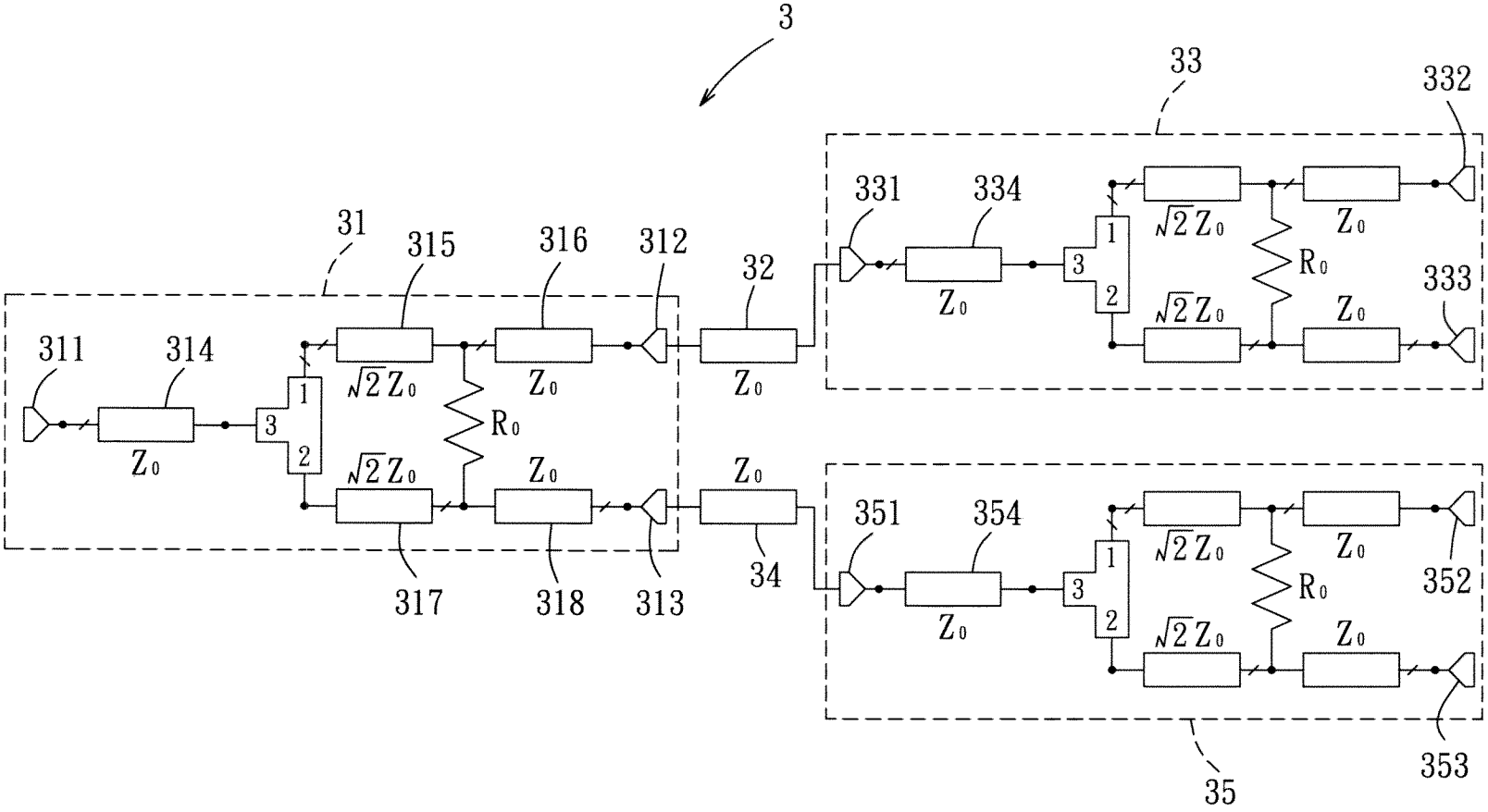
FIG. 4 is a circuit diagram of a first embodiment of a one input to four output power divider according to the present invention.

Referring to FIG. 4, a first embodiment of a one input to four output power divider according to the present invention is illustrated. In this embodiment, the one input to four output power divider 3 is implemented on a printed circuit board, is operable in a specified frequency band, and comprises a first microstrip power divider 31, a first quarter-wavelength microstrip 32, a second microstrip power divider 33, a second quarter-wavelength microstrip 34, and a third microstrip power divider 35.

Each of the first microstrip power divider 31, the second microstrip power divider 33 and the third microstrip power divider 35 has a design based on the Wilkinson power divider, and has a respective input terminal 311, 331 and 351, and two respective output terminals 312, 313, 332, 333, 352 and 353. Each of the first, second and third microstrip power dividers 31, 33 and 35 (the first microstrip power divider 31 is given as an example herein) includes a first microstrip 314 connected to the respective input terminal 311, a second microstrip 315 and a third microstrip 316 connected in series between the respective input terminal 311 and one of the respective output terminals 312, a fourth microstrip 317 and a fifth microstrip 318 connected in series between the respective input terminal 311 and the other one of the respective output terminals 313, and an output resistor (Ro) connected between a junction of the second and third microstrips 315 and 316 and a junction of the fourth and fifth microstrips 317 and 318.

Figure 8:
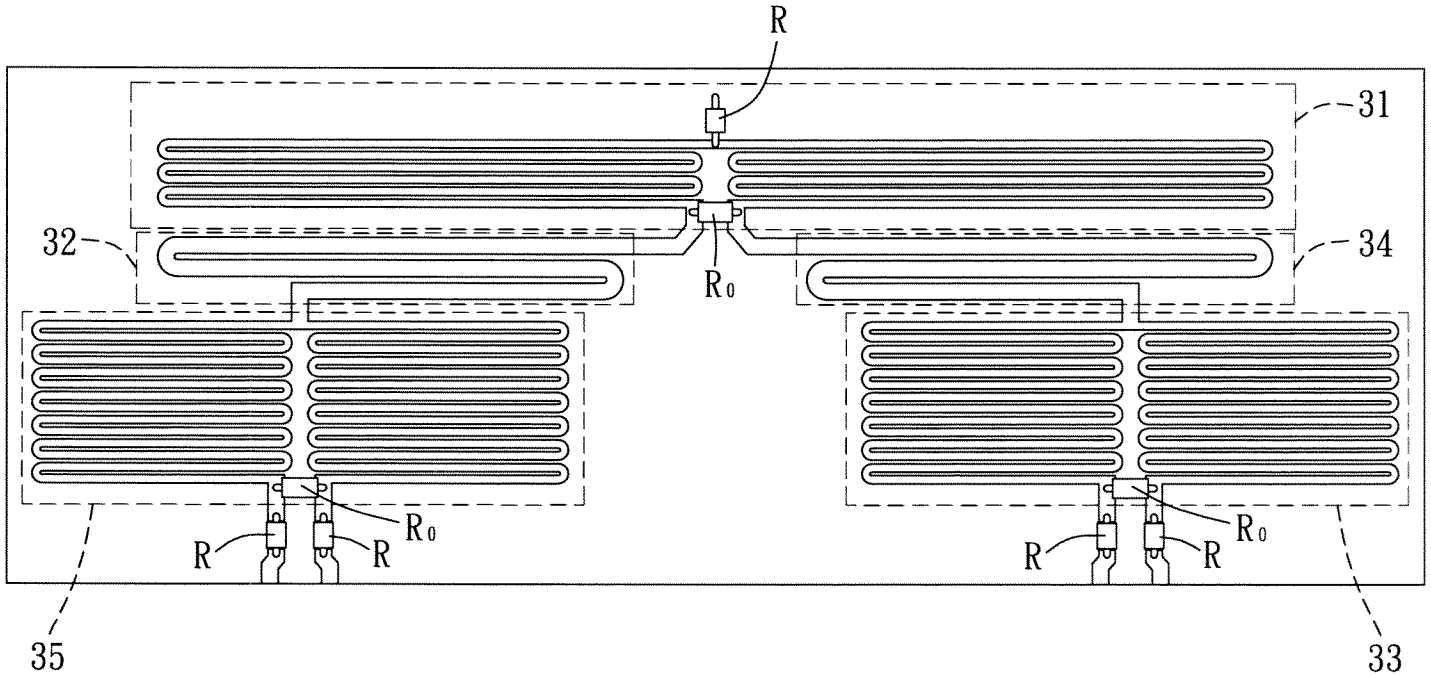
FIG. 8 is a schematic diagram of a physical circuit of the second embodiment of the one input to four output power divider.

In this embodiment, the specified frequency band in which the one input to four output power divider 3 is operable ranges from 50 MHz to 806 MHz. Each of the second and fourth microstrips 315 and 317 has a length corresponding to a quarter of a wavelength of a signal at a specified frequency within the specified frequency band. The specified frequency is the center frequency 428 MHz of a working frequency band of the one input to four output power divider 3 (i.e., the specified frequency band). The length of each of the second and fourth microstrips 315 and 317 corresponding to a quarter of the wavelength of the 428 MHz signal may be increased along with increment in the times the second and fourth microstrips 315 and 317 are bent (as shown in FIG. 8). The reason is, in the practical process of circuit layout, for the purpose of achieving a smaller layout area, the circuit layout is implemented in a way that the microstrips are bent, and thus a coupling effect may result among the bends of the microstrips. Therefore, for the purpose of reducing the coupling effect there among, the microstrips are required to be longer to maintain the working frequency band. The first microstrip 314 is mainly an input microstrip of the first microstrip power divider 31, and generally has a shorter strip length in circuit layout so as to prevent an excessive loss of the one input to four output power divider 3. The third microstrip 316 and the fifth microstrip 318 are output microstrips of the first microstrip power divider 31, and preferably have a shorter length. Each of the first, third and fifth microstrips 314, 316 and 318 has a characteristic impedance of $Z_0$, and each of the second and fourth microstrips 315 and 317 has a characteristic impedance of $\sqrt{2}Z_0$. In this embodiment, $Z_0$ is 75 ohms.

In this embodiment, an insulation substrate material of the printed circuit board is a FR4 (flame retardant 4) material. The FR4 material usually has a dielectric coefficient ranging from 4 to 4.7, and an intermediate value of 4.4 is adopted herein. In order to calculate the dimensions of the microstrips, aside from the dielectric coefficient, a thickness of the insulation substrate (0.8 mm in this embodiment), the loss tangent (0.0245 in this embodiment), a thickness of the metal layer (0.035 mm in this embodiment), and a reference frequency are also required. When a TRL (transmission line) simulator (for example, the Ansoft® Serenade) is adopted for calculation, the aforementioned parameters are inputted so as to obtain the dimensions of the microstrips. When the insulation substrate is made of a different material, the design method for the microstrips is the same, and only the calculated dimensions of the microstrips differ. In this way, each of the first microstrip power divider 31, the second microstrip power divider 33 and the third microstrip power divider 35 has an input impedance at the respective input terminal 311, 331 and 351, and has output impedances at the respective output terminals 312, 313, 332, 333, 352 and 353. The input impedance and the output impedances are substantially equal to the characteristic impedances of $Z_0$ of the first, third and fifth microstrips 314, 316 and 318, i.e., 75 ohms.

The first quarter-wavelength microstrip 32 has a length corresponding to a quarter of a wavelength of a signal at a specified frequency, i.e., 700 MHz, within the specified frequency band (the length of the first quarter-wavelength microstrip 32 is calculated according to a center frequency of 700 MHz). The first quarter-wavelength microstrip 32 further has an end coupled electrically to one of the output terminals 312 of the first microstrip power divider 31, and has a characteristic impedance substantially equal to the output impedance of the first microstrip power divider 31 at said one of the output terminals 312 coupled to the first quarter-wavelength microstrip 32 (or the characteristic impedance of $Z_0$ of the third microstrip 316), i.e., 75 ohms. The input terminal 331 of the second microstrip power divider 33 is coupled electrically to another end of the first quarter-wavelength microstrip 32. The second microstrip power divider 33 has an input impedance at the input terminal 331 thereof (or the characteristic impedance of $Z_0$ of the first microstrip 339) substantially equal to the characteristic impedance of the first quarter-wavelength microstrip 32.

The second quarter-wavelength microstrip 34 has a length corresponding to that of the first quarter-wavelength microstrip 32, that is a quarter of the wavelength of the signal at the specified frequency (i.e., 700 MHz) within the specified frequency band. The second quarter-wavelength microstrip 34 further has an end coupled electrically to the other one of the output terminals 313 of the first microstrip power divider 31, and has a characteristic impedance substantially equal to an output impedance of the first microstrip power divider 31 at said other one of the output terminals 313 coupled to the second quarter-wavelength microstrip 34 (or the characteristic impedance of $Z_0$ of the fifth microstrip 318), i.e., 75 ohms.

The input terminal 351 of the third microstrip power divider 35 is coupled electrically to another end of the second quarter-wavelength microstrip 34. The third microstrip power divider 35 has an input impedance at the input terminal 351 thereof (or the characteristic impedance of $Z_0$ of the first microstrip 354) substantially equal to the characteristic impedance of the second quarter-wavelength microstrip 34.

In this embodiment, an overall length of the first quarter-wavelength microstrip 32 must cover the length of the third microstrip 316. An overall length of the second quarter-wavelength microstrip 34 must likewise cover the length of the fifth microstrip 318.

Figure 5:
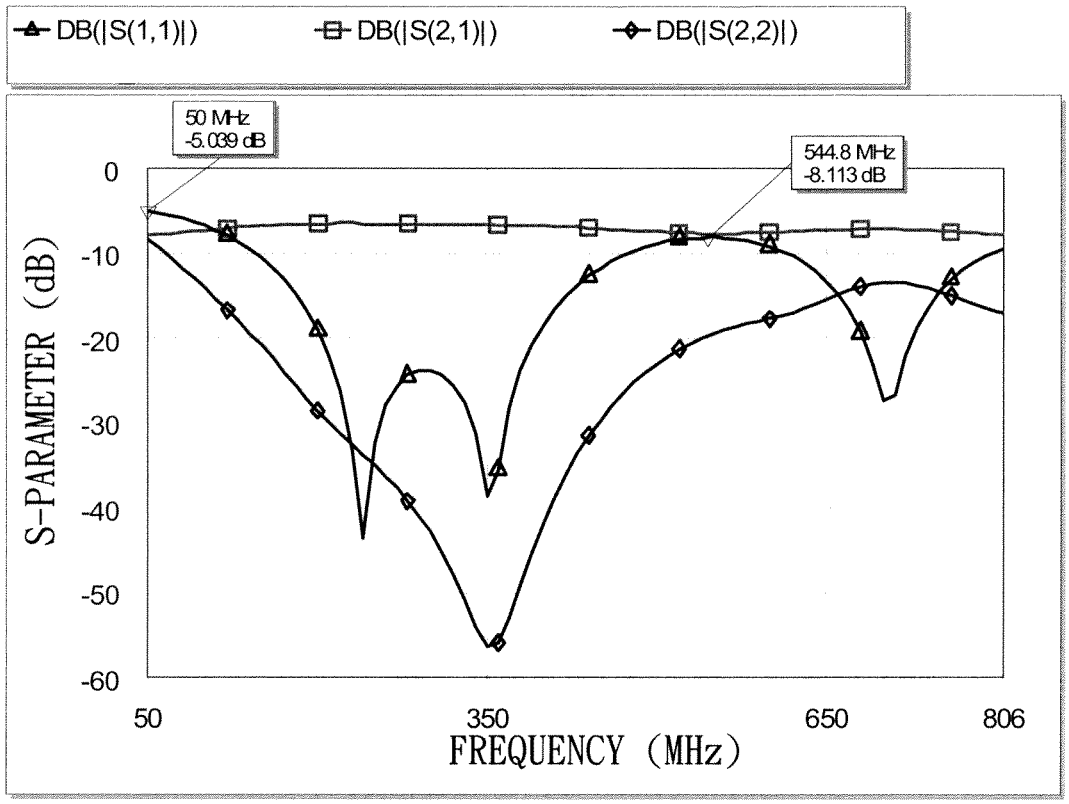
FIG. 5 is a plot of S-parameter measured by simulating the first embodiment of the one input to four output power divider in FIG. 4.
Figure 6:
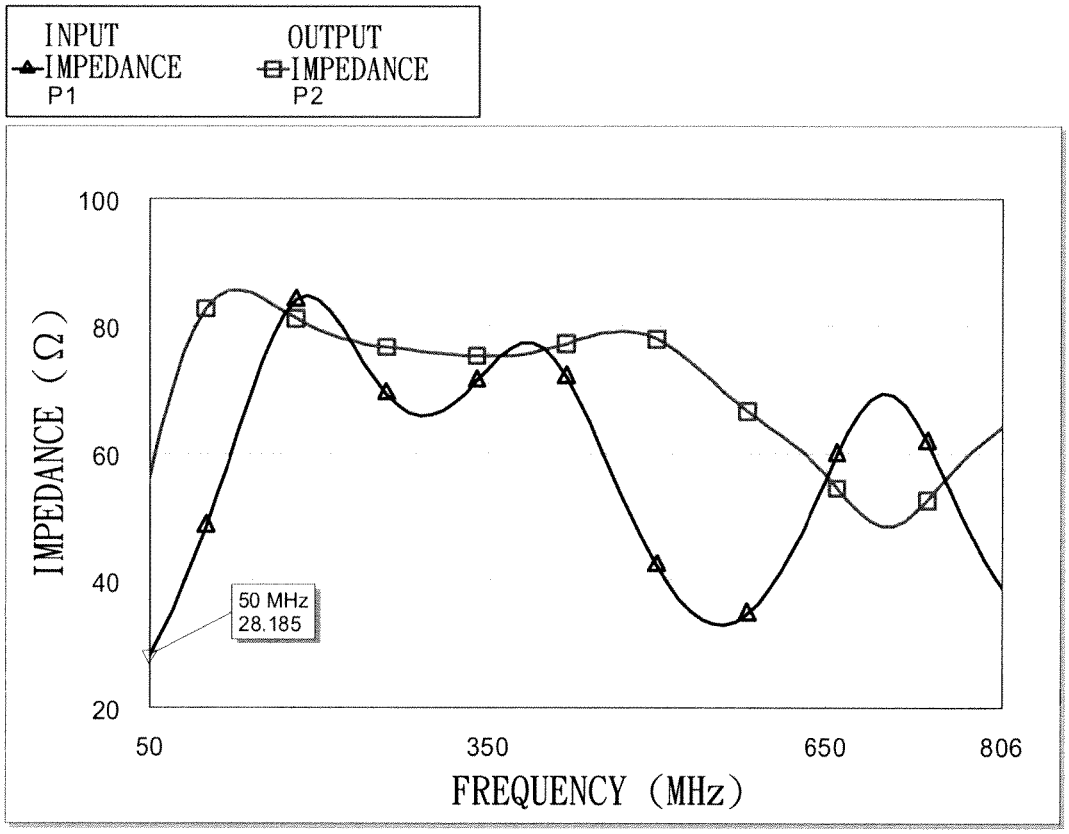
FIG. 6 is a plot of an input impedance and an output impedance of the first embodiment of the one input to four output power divider which operates in a specified frequency band ranging from 50 MHz to 806 MHz.

In this way, by virtue of adding the first quarter-wavelength microstrip 32 between the first and second microstrip power dividers 31 and 33 and adding the second quarter-wavelength microstrip between the first and third microstrip power dividers 31 and 35, the purpose of impedance matching is achieved. Referring to FIG. 5, the Microwave Office is utilized for analytical simulation so as to obtain the S-parameters of the first embodiment of the one input to four output power divider 3 which operates in the specified frequency band ranging from 50 MHz to 806 MHz. It is noted from the plot that the reflection coefficients S(1, 1) at the vicinity of the specified frequency of 700 MHz are all smaller than −8 dB, and thus the working bandwidth of this embodiment is effectively increased compared with that of the aforementioned conventional one input to four output power divider 2. However, it is further noted that the reflection coefficients S(1, 1) at the vicinity of the working frequency of 50 MHz are still larger than −8 dB. The reason is that, referring to FIG. 6, where an input impedance and an output impedance of the first embodiment of the one input to four output power divider 3 which operates in the specified frequency band ranging from 50 MHz to 806 MHz are illustrated, the characteristic impedance of the first embodiment of the one input to four output power divider 3 which operates at 50 MHz is a relatively low impedance, and may hardly match the 75 ohm impedance. Therefore, the embodiment has a poor reflection coefficient characteristic when operating at 50 MHz.

Figure 7:
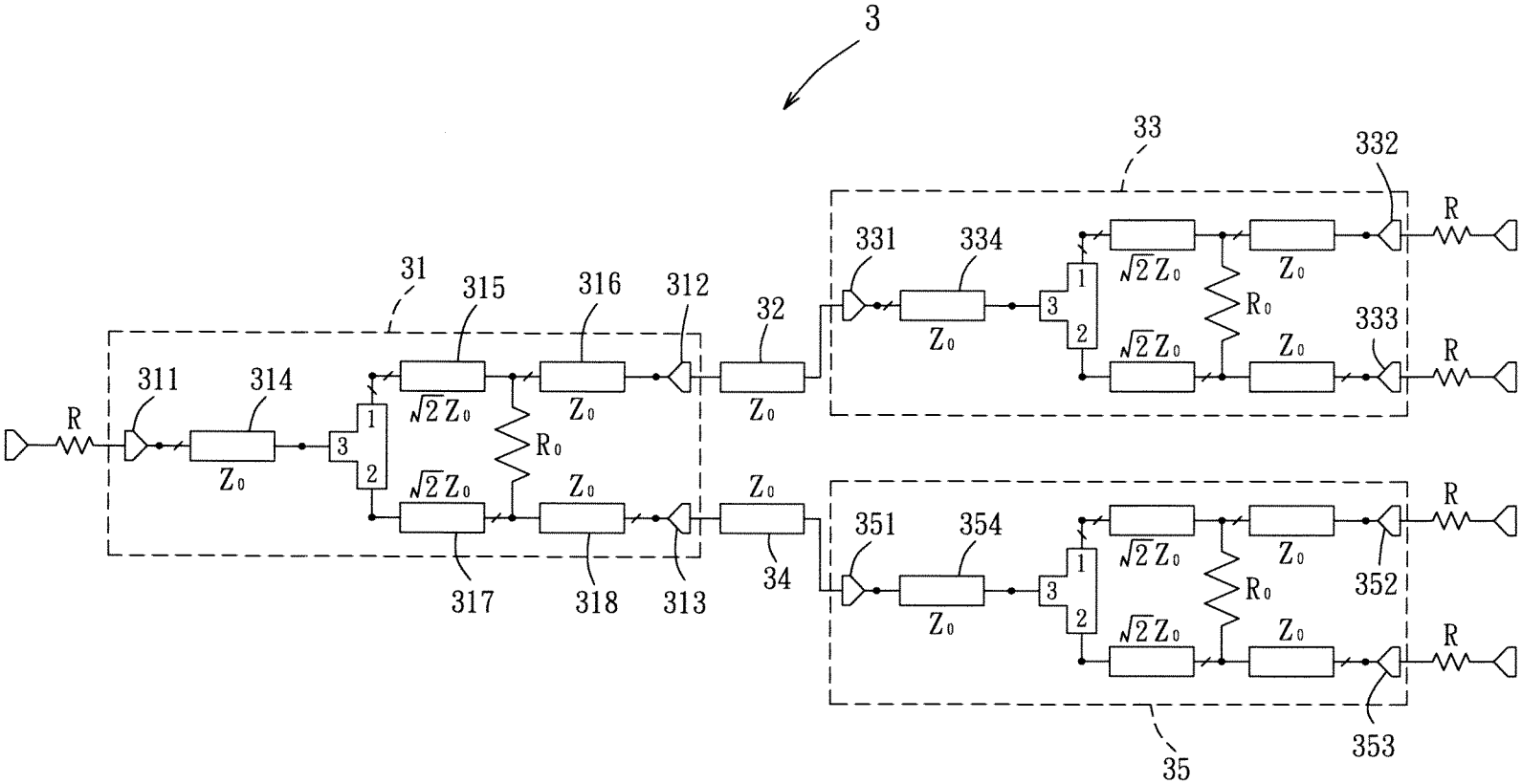
FIG. 7 is a circuit diagram of a second embodiment of the one input to four output power divider according to the present invention.

Referring to FIG. 7, a second embodiment of the one input to four output power divider according to the present invention is illustrated. The second embodiment is similar to the first embodiment, and differs in the configuration that the second embodiment further comprises five resistors (R) each connected to a respective one of the input terminal 331 of the first microstrip power divider 31, the two output terminals 332 and 333 of the second microstrip power divider 33, and the two output terminals 352 and 353 of the third microstrip power divider 35 of the first embodiment of the one input to four output power divider 3, so as to increase the input impedance and the output impedances of the one input to four output power divider 3. Each of the resistors (R) has a resistance of about 10 ohms. In the second embodiment, 15 ohms is taken as an example for the resistance. It is noted that, the resistance of each of the resistors (R) is not limited to about 10 ohms, and is mainly determined according to a magnitude of the reflection coefficient of the one input to four output power divider 3 when operating at a minimum working frequency, such as 50 MHz in this embodiment. Referring to FIG. 8, a schematic diagram of a physical circuit of the second embodiment of the one input to four output power divider 3 is illustrated.

Figure 9:
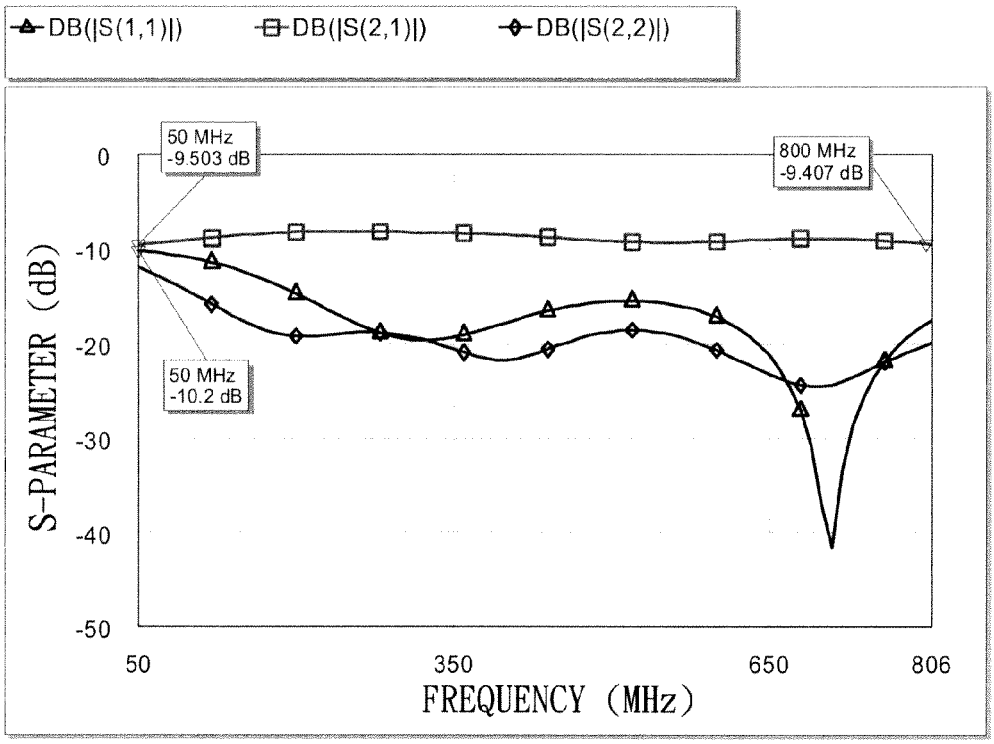
FIG. 9 is a plot of S-parameter measured by simulating the second embodiment of the one input to four output power divider.

In this way, it is noted from a plot of the S-parameter measured by simulating the second embodiment of the one input to four output power divider 3 which operates in the specified frequency band ranging from 50 MHz to 806 MHz as shown in FIG. 9, the reflection coefficients S(1, 1) from 50 MHz to 806 MHz are all lower than −10 dB and the second embodiment thus has relatively good characteristics. Further, transmission coefficients S(2, 1) of the second embodiment are not lower than −10 dB.

To sum up, in the first embodiment, by virtue of adding the first quarter-wavelength microstrip 32 between the first and second microstrip power dividers 31 and 33 and adding the second quarter-wavelength microstrip 34 between the first and third microstrip power dividers 31 and 35 for the purpose of impedance matching, the issue of the poor reflection coefficient at the specified frequency of 700 MHz may be improved, and the working bandwidth of the one input to four output power divider 3 may be increased. Moreover, by virtue of connecting each of the resistors (R) to a respective one of the input terminal 311 of the first microstrip power divider 31, the two output terminals 332 and 333 of the second microstrip power divider 33, and the two output terminals 352 and 353 of the third microstrip power divider 35, the issue of the inferior reflection coefficient at the frequency of 50 MHz attributed to the insufficient impedance may be improved so as to further increase the working bandwidth of the one input to four output power divider 3, such that the power divider may operate at a lower frequency band. In this way, the one input to four output power divider 3 may be adopted to replace the conventional wired transformer and is operable in the aforementioned specified frequency band so as to achieve the effects of lower costs, shorter labor hours, and higher working stability.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A one input to four output power divider operable in a specified frequency band, and comprising:

a first microstrip power divider having an input terminal and two output terminals;

a first quarter-wavelength microstrip which has a length corresponding to a quarter of a wavelength of a signal at a specified frequency within the specified frequency band, which has an end coupled electrically to one of said output terminals of said first microstrip power divider, and which has a characteristic impedance substantially equal to an output impedance of said first microstrip power divider at said one of said output terminals coupled to said first quarter-wavelength microstrip;

a second microstrip power divider which has an input terminal and two output terminals, said input terminal of said second microstrip power divider being coupled electrically to another end of said first quarter-wavelength microstrip, said second microstrip power divider having an input impedance at said input terminal thereof substantially equal to the characteristic impedance of said first quarter-wavelength microstrip;

a second quarter-wavelength microstrip which has a length corresponding to a quarter of the wavelength of the signal at the specified frequency, which has an end coupled electrically to the other one of said output terminals of said first microstrip power divider, and which has a characteristic impedance substantially equal to an output impedance of said first microstrip power divider at said other one of said output terminals coupled to said second quarter-wavelength microstrip; and a third microstrip power divider which has an input terminal and two output terminals, said input terminal of said third microstrip power divider being coupled electrically to another end of said second quarter-wavelength microstrip, said third microstrip power divider having an input impedance at said input terminal thereof substantially equal to the characteristic impedance of said second quarter-wavelength microstrip;

wherein each of said first microstrip power divider, said second microstrip power divider and said third microstrip power divider includes:

a first microstrip connected to said respective input terminal, a second microstrip and a third microstrip connected in series between said respective input terminal and one of said respective output terminals, a fourth microstrip and a fifth microstrip connected in series between said respective input terminal and the other one of said respective output terminals, and an output resistor connected between a junction of said second and third microstrips and a junction of said fourth and fifth microstrips;

wherein each of said first, third and fifth microstrips has a characteristic impedance of $Z_0$, and each of said second and fourth microstrips has a characteristic impedance of $\sqrt{2}\,Z_0$; and wherein the output impedance of said first microstrip power divider at said one of said output terminals is substantially equal to the characteristic impedance of said third microstrip, the output impedance of said first microstrip power divider at said other one of said output terminals is substantially equal to the characteristic impedance of said fifth microstrip, and the input impedance of each of said first, second and third microstrip power dividers at said respective input terminal is substantially equal to the characteristic impedance of said first microstrip.

2. The one input to four output power divider as claimed in claim 1, wherein at least one of said first microstrip power divider, said second microstrip power divider and said third microstrip power divider has a design based on the Wilkinson power divider.

3. The one input to four output power divider as claimed in claim 1, wherein $Z_0$ is 75 ohms.

4. The one input to four output power divider as claimed in claim 1, further comprising five resistors each connected to a respective one of said input terminal of said first microstrip power divider, said two output terminals of said second microstrip power divider, and said two output terminals of said third microstrip power divider.

5. The one input to four output power divider as claimed in claim 4, wherein the specified frequency band ranges from 50 MHz to 806 MHz, the specified frequency is 700 MHz, the characteristic impedance of each of said first and second quarter-wavelength microstrips is 75 ohms, and each of said five resistors has a resistance of 15 ohms.

6. The one input to four output power divider as claimed in claim 1, wherein the specified frequency band ranges from 50 MHz to 806 MHz, and the specified frequency is 700 MHz.

* * * * *